US012241148B2

(12) United States Patent
Takabe et al.

(10) Patent No.: US 12,241,148 B2
(45) Date of Patent: Mar. 4, 2025

(54) ALLOY MATERIAL AND OIL-WELL SEAMLESS PIPE

(71) Applicant: NIPPON STEEL CORPORATION, Tokyo (JP)

(72) Inventors: Hideki Takabe, Tokyo (JP); Yusaku Tomio, Tokyo (JP); Masayuki Sagara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 477 days.

(21) Appl. No.: 17/753,896

(22) PCT Filed: Oct. 1, 2020

(86) PCT No.: PCT/JP2020/037453
§ 371 (c)(1),
(2) Date: Mar. 17, 2022

(87) PCT Pub. No.: WO2021/070735
PCT Pub. Date: Apr. 15, 2021

(65) Prior Publication Data

US 2022/0411906 A1 Dec. 29, 2022

(30) Foreign Application Priority Data

Oct. 10, 2019 (JP) ..... 2019-186480

(51) Int. Cl.
*C22C 30/02* (2006.01)
*C22F 1/16* (2006.01)

(52) U.S. Cl.
CPC ..... *C22C 30/02* (2013.01); *C22F 1/16* (2013.01)

(58) Field of Classification Search
CPC ..... C22C 30/02; C22C 19/055; C22F 1/10; C22F 1/16
See application file for complete search history.

(56) References Cited

U.S. PATENT DOCUMENTS

| | | | |
|---|---|---|---|
| 4,400,209 | A | 8/1983 | Kudo et al. |
| 2002/0141897 | A1 | 10/2002 | Ernst et al. |
| 2009/0291017 | A1 | 11/2009 | Otome et al. |
| 2011/0067475 | A1 | 3/2011 | Murakami et al. |
| 2016/0265694 | A1 | 9/2016 | Tomio et al. |

FOREIGN PATENT DOCUMENTS

| | | | |
|---|---|---|---|
| CN | 102056686 | A | 5/2011 |
| CN | 105723009 | A | 6/2016 |
| JP | 57131340 | A | 8/1982 |
| JP | 57203735 | A | 12/1982 |
| JP | 57207149 | A | 12/1982 |
| JP | 58210155 | A | 12/1983 |
| JP | 63274743 | A | 11/1988 |
| JP | 11302801 | A | 11/1999 |
| JP | 2009084668 | A | 4/2009 |

OTHER PUBLICATIONS

Smith, G. D., and S. J. Patel. "The role of niobium in wrought precipitation-hardened nickel-base alloys." Superalloys 718.625 (2005): 135-154.*

* cited by examiner

*Primary Examiner* — Jessee R Roe
(74) *Attorney, Agent, or Firm* — Greer, Burns & Crain, Ltd.

(57) ABSTRACT

An alloy material is provided that has a chemical composition consisting of, in mass %, C: 0.030% or less, Si: 0.01 to 1.0%, Mn: 0.01 to 2.0%, P: 0.030% or less, S: 0.0050% or less, Cr: 28.0 to 40.0%, Ni: 32.0 to 55.0%, sol. Al: 0.010 to 0.30%, N: more than 0.30% and not more than $0.000214\times Ni^2-0.03012\times Ni+0.00215\times Cr^2-0.08567\times Cr+1.927$, O: 0.010% or less, Mo: 0 to 6.0%, W: 0 to 12.0%, Ca: 0 to 0.010%, Mg: 0 to 0.010%, V: 0 to 0.50%, Ti: 0 to 0.50%, Nb: 0 to 0.50%, Co: 0 to 2.0%, Cu: 0 to 2.0%, REM: 0 to 0.10%, and the balance: Fe and impurities, and in which Fn1=Mo+(½)W is 1.0 to 6.0, and a yield strength at a 0.2% proof stress is 1103 MPa or more.

6 Claims, No Drawings

ALLOY MATERIAL AND OIL-WELL SEAMLESS PIPE

TECHNICAL FIELD

The present invention relates to an alloy material and an oil-well seamless pipe.

BACKGROUND ART

The development of oil fields and natural gas fields (hereinafter referred to as "oil fields") at greater depths is rapidly progressing year by year, and oil country tubular goods that are used in the development of oil fields are required to have strength to withstand the temperatures and pressures of production fluid in addition to strength to withstand high formation pressures.

In addition, oil country tubular goods are required to not only have high strength, but to also be excellent in corrosion resistance, particularly stress corrosion cracking resistance, with respect to corrosive gases such as hydrogen sulfide ($H_2S$), carbon dioxide ($CO_2$) and chloride ions ($Cl^-$) included in crude oil and natural gas.

To address this problem, alloys for oil country tubular goods that are excellent in strength and stress corrosion cracking resistance have been developed. For example, Patent Documents 1 and 2 disclose alloys in which the 0.2% proof stress is 1055 MPa and which have good stress corrosion cracking resistance in a corrosive environment of 150° C. Patent Document 3 discloses an alloy in which the 0.2% proof stress is 939 MPa and which has good stress corrosion cracking resistance in a corrosive environment of 150° C.

Patent Document 4 discloses a high Cr-high Ni alloy in which the 0.2% proof stress is 861 to 964 MPa and which has good stress corrosion cracking resistance in a corrosive environment of 180° C. Patent Document 5 discloses a Cr—Ni alloy material in which the 0.2% proof stress is 1176 MPa and which has good stress corrosion cracking resistance in a corrosive environment of 177° C. Patent Document 6 discloses an austenitic alloy that has high corrosion cracking resistance in an environment in which hydrogen sulfide is present.

LIST OF PRIOR ART DOCUMENTS

Patent Documents

Patent Document 1: JP57-203735A
Patent Document 2: JP57-207149A
Patent Document 3: JP58-210155A
Patent Document 4: JP11-302801A
Patent Document 5: JP2009-84668A
Patent Document 6: JP63-274743A

SUMMARY OF INVENTION

Technical Problem

In recent years, the development of oil fields in ultra-high temperature and high pressure environments in which the formation temperature is 200° C. or more and the formation pressure is 137 MPa or more has started. Oil country tubular goods to be used in the development of such oil fields must withstand higher pressures and higher temperatures than in the past. Further, in an ultra-high pressure environment, because the partial pressure of a corrosive gas is also high, the corrosive environment is more severe than in the conventional oil field environments.

In view of this background, there is an increasing desire for oil country tubular goods having a strength corresponding to a 0.2% proof stress of 1103 MPa (160 ksi) or more, and which are excellent in stress corrosion cracking resistance in a corrosive environment of 200° C. or more. However, in the alloys disclosed in Patent Documents 1 to 6, sufficient consideration has not been given to stress corrosion cracking resistance and strength in a corrosive environment of 200° C. or more, and there remains room for improvement.

An object of the present invention is to solve the above problem and provide an alloy material and an oil-well seamless pipe in which the 0.2% proof stress are 1103 MPa or more and which has excellent stress corrosion cracking resistance with respect to a corrosive gas of 200° C. or more.

Solution to Problem

The present invention has been made to solve the problem described above, and the gist of the present invention is an alloy material and an oil-well seamless pipe which are described hereunder.

(1) An alloy material, having:
a chemical composition consisting of, in mass %,
C: 0.030% or less,
Si: 0.01 to 1.0%,
Mn: 0.01 to 2.0%,
P: 0.030% or less,
S: 0.0050% or less,
Cr: 28.0 to 40.0%,
Ni: 32.0 to 55.0%,
sol. Al: 0.010 to 0.30%,
N: more than 0.30% and not more than $N_{max}$ that is defined by formula (i) below,
O: 0.010% or less,
Mo: 0 to 6.0%,
W: 0 to 12.0%,
Ca: 0 to 0.010%,
Mg: 0 to 0.010%,
V: 0 to 0.50%,
Ti: 0 to 0.50%,
Nb: 0 to 0.50%,
Co: 0 to 2.0%,
Cu: 0 to 2.0%,
REM: 0 to 0.10%, and
the balance: Fe and impurities,
wherein:
Fn1 defined by formula (ii) below is 1.0 to 6.0, and
a yield strength at a 0.2% proof stress is 1103 MPa or more;

$$N_{max}=0.000214\times Ni^2-0.03012\times Ni+0.00215\times Cr^2-0.08567\times Cr+1.927 \quad \text{(i)}$$

$$Fn1=Mo+(1/2)W \quad \text{(ii)}$$

where, each symbol of an element in the above formulas represents a content (mass %) of the corresponding element contained in the alloy material, with 0 being substituted when the corresponding element is not contained.

(2) The alloy material according to (1) above, wherein:
the chemical composition contains one or more kinds of element selected from, in mass %,
V: 0.01 to 0.50%,
Ti: 0.01 to 0.50%, and
Nb: 0.01 to 0.50%.

(3) The alloy material according to (1) or (2) above, wherein:

the chemical composition contains one or more kinds of element selected from, in mass %, Co: 0.1 to 2.0%, Cu: 0.1 to 2.0%, and REM: 0.0005 to 0.10%.

(4) The alloy material according to any one of (1) to (3) above, wherein:

a grain size number of austenite grains in a cross section parallel to a rolling direction and a thickness direction is 1.0 or more.

(5) The alloy material according to any one of (1) to (4) above, wherein:

the alloy material is used as an oil-well seamless pipe.

(6) An oil-well seamless pipe, which uses the alloy material according to (5) above.

Advantageous Effects of Invention

According to the present invention, it is possible to provide an alloy material and an oil-well seamless pipe which are excellent in strength and in stress corrosion cracking resistance at high temperatures.

DESCRIPTION OF EMBODIMENTS

In general, if the strength of an alloy material is secured, the stress corrosion cracking resistance will decrease. Therefore, in order to obtain an alloy material that is excellent in both strength and stress corrosion cracking resistance, the present inventors conducted basic investigations with a view to improving strength and stress corrosion cracking resistance using alloy materials having chemical compositions that were adjusted in various ways.

As a result, the present inventors clarified that in order to improve the yield strength of an alloy material, first, making the content of N in the alloy more than 0.30% and increasing the content of N in a dissolved state (hereinafter, referred to as "amount of dissolved N") in the matrix is effective means for improving the yield strength.

On the other hand, if the content of N is simply increased to increase the strength, Cr will precipitate as a nitride, and the content of Cr will decrease. Since the contents of Ni and Cr in an alloy have a significant influence on the stress corrosion cracking resistance at high temperatures, if Cr decreases, good stress corrosion cracking resistance cannot be stably obtained. Therefore, the present inventors discovered that it is necessary to make the content of N not more than $N_{max}$ which is calculated by $0.000214\times Ni^2-0.03012\times Ni+0.00215\times Cr^2-0.08567\times Cr+1.927$.

In addition, it has been found that when Mo and W which have an effect that improves stress corrosion cracking resistance are added within a range in which the value of $Fn1=Mo+(1/2)W$ becomes 1.0 to 6.0, desired stress corrosion cracking resistance can be secured in a corrosive environment that is the object of the present invention.

The present invention has been made based on the above findings. The respective requirements of the present invention are described in detail hereunder.

(A) Chemical Composition

The reasons for limiting each element are as follows. Note that, the symbol "%" with respect to content in the following description means "mass percent".

C: 0.030% or Less

C is contained as an impurity, and due to precipitation of $M_{23}C_6$-type carbides ("M" denotes an element such as Cr, Mo and/or Fe), stress corrosion cracking accompanied by intergranular fracture is liable to occur. Therefore, the content of C is set to 0.030% or less. The content of C is preferably 0.020% or less, and more preferably is 0.015% or less. Note that, the content of C is preferably reduced as much as possible, that is, although the content may be 0%, an extreme reduction will lead to an increase in the production cost. Therefore, the content of C is preferably 0.0005% or more, and more preferably is 0.0010% or more.

Si: 0.01 to 1.0%

Si is an element that is necessary for deoxidation. However, if an excessive amount of Si is contained, there is a tendency for the hot workability to decrease. Therefore, the content of Si is set in the range of 0.01 to 1.0%. The content of Si is preferably 0.05% or more, and more preferably is 0.10% or more. Further, the content of Si is preferably 0.80% or less, and more preferably is 0.50% or less.

Mn: 0.01 to 2.0%

Although Mn is an element that is necessary for deoxidation and/or as a desulfurizing agent, if the content of Mn is less than 0.01%, the effect will not be sufficiently exerted. However, when Mn is excessively contained, the hot workability decreases. Therefore, the content of Mn is set in the range of 0.01 to 2.0%. The content of Mn is preferably 0.10% or more, and more preferably is 0.20% or more. Further, the content of Mn is preferably 1.5% or less, and more preferably is 1.0% or less.

P: 0.030% or Less

P is an impurity contained in the alloy, and markedly decreases hot workability and stress corrosion cracking resistance. Therefore, the content of P is set to 0.030% or less. The content of P is preferably 0.025% or less, and more preferably is 0.020% or less.

S: 0.0050% or Less

Similarly to P, S is an impurity that markedly decreases hot workability. Therefore, the content of S is set to 0.0050% or less. The content of S is preferably 0.0030% or less, more preferably is 0.0010% or less, and further preferably is 0.0005% or less.

Cr: 28.0 to 40.0%

Cr is an element that causes the amount of dissolved N to increase, and also markedly improves the stress corrosion cracking resistance. The effects of Cr will not be sufficient if the content of Cr is 28.0% or less. However, if Cr is excessively contained, it will lead to a reduction in hot workability, and a TCP phase as typified by a phase will be liable to form and the stress corrosion cracking resistance will decrease. Therefore, the content of Cr is set in the range of 28.0 to 40.0%. The content of Cr is preferably 29.0% or more, and more preferably is 30.0% or more. Further, the content of Cr is preferably 38.0% or less, and more preferably is 35.0% or less.

Ni: 32.0 to 55.0%

Ni is an important element for stabilizing austenite and obtaining excellent stress corrosion cracking resistance at high temperatures of 200° C. or more. However, if Ni is excessively added, the amount of dissolved N will decrease, and it will also lead to an increase in cost and a reduction in hydrogen cracking resistance. Therefore, the content of Ni is set in the range of 32.0 to 55.0%. The content of Ni is preferably 34.0% or more, more preferably is more than 36.0%, and further preferably is 37.0% or more. Further, the content of Ni is preferably 53.0% or less, more preferably is 50.0% or less, and further preferably is 45.0% or less.

sol. Al: 0.010 to 0.30%

Al immobilizes O (oxygen) in an alloy as an Al oxide, and thereby not only improves hot workability, but also improves the impact resistance and corrosion resistance of the product. However, if sol. Al is excessively contained, on the contrary, it will cause the hot workability to decrease. Therefore, the content of Al is set in the range of 0.010 to 0.30% in terms of sol. Al. The content of Al in terms of sol. Al is preferably 0.020% or more, and more preferably is 0.050% or more. Further, the content of Al in terms of sol. Al is preferably 0.25% or less, and more preferably is 0.20% or less.

N: More than 0.30% and not More than $N_{max}$ Defined by Formula (i)

Although N has an action that increases the strength of the alloy material, the desired strength cannot be secured if the content of N is 0.30% or less. However, if the content of N is excessive, it will induce precipitation of a large amount of chromium nitride, leading to a deterioration in the stress corrosion cracking resistance. Therefore, the content of N is set within a range of more than 0.30% to not more than $N_{max}$ that is defined by formula (i) below. The content of N is preferably 0.31% or more, more preferably is 0.32% or more, and further preferably is 0.35% or more.

$$N_{max}=0.000214\times Ni^2-0.03012\times Ni+0.00215\times Cr^2-0.08567\times Cr+1.927 \quad (i)$$

where, each symbol of an element in the above formula represents a content (mass %) of the corresponding element contained in the alloy material.

O: 0.010% or less

O is an impurity contained in the alloy, and decreases stress corrosion cracking resistance and hot workability. Therefore, the content of O is set to 0.010% or less. The content of O is preferably 0.008% or less, and more preferably is 0.005% or less.

Mo: 0 to 6.0%

Mo contributes to stabilization of a corrosion protection film formed on the alloy surface, and has an effect that improves stress corrosion cracking resistance in an environment with a temperature of more than 200° C., and therefore may be contained as necessary. However, if Mo is excessively contained, it will cause the hot workability and economic efficiency to decrease. Therefore, the content of Mo is set to 6.0% or less. The content of Mo is preferably 5.5% or less, and more preferably is 5.0% or less. Note that, when it is desired to obtain the aforementioned effect, the content of Mo is preferably 1.0% or more, more preferably is 2.0% or more, and further preferably is 3.0% or more.

W: 0 to 12.0%

Similarly to Mo, W contributes to the stability of a corrosion protection film formed on the alloy surface, and has an effect that improves stress corrosion cracking resistance in an environment with a temperature of more than 200° C., and therefore may be contained as necessary. However, if W is excessively contained, it will cause the hot workability and economic efficiency to decrease. Therefore, the content of W is set to 12.0% or less. The content of W is preferably 11.0% or less, and more preferably is 10.0% or less. Note that, when it is desired to obtain the aforementioned effect, the content of W is preferably 1.0% or more, more preferably is 2.0% or more, and further preferably is 4.0% or more.

Fn1: 1.0 to 6.0

As mentioned above, Mo and W influence the stress corrosion cracking resistance. If Fn1 defined by the following formula (ii) is less than 1.0, in a corrosive environment that is the object of the present invention, the desired stress corrosion cracking resistance cannot be secured. Further, if Mo and W are contained in amounts such that Fn1 is more than 6.0, it will decrease the economic efficiency. Therefore, Fn1 is set in the range of 1.0 to 6.0. Fn1 is preferably 2.0 or more, and more preferably is 3.0 or more. Further, Fn1 is preferably 5.5 or less, and more preferably is 5.0 or less.

$$Fn1=Mo+(1/2)W \quad (ii)$$

where, each symbol of an element in the above formula represents a content (mass %) of the corresponding element contained in the alloy material, with 0 being substituted when the corresponding element is not contained.

Note that, it is not necessary that Mo and W are contained in combination with each other. In the case of containing Mo alone, it suffices that the content of Mo is from 1.0 to 6.0%, and in the case of containing W alone, it suffices that the content of W is from 2.0 to 12.0%.

Ca: 0 to 0.010%

Ca has an action that improves hot workability in a low temperature range, and therefore may be contained as necessary. However, if Ca is excessively contained, the amount of inclusions will increase and, on the contrary, the hot workability will be reduced. Therefore, the content of Ca is set to 0.010% or less. The content of Ca is preferably 0.008% or less, and more preferably is 0.005% or less. Note that, when it is desired to obtain the aforementioned effect, the content of Ca is preferably 0.0003% or more, and more preferably is 0.0005% or more.

Mg: 0 to 0.010%

Similarly to Ca, Mg has an action that improves hot workability in a low temperature range, and therefore may be contained as necessary. However, if Mg is excessively contained, the amount of inclusions will increase and, on the contrary, the hot workability will be reduced. Therefore, the content of Mg is set to 0.010% or less. The content of Mg is preferably 0.008% or less, and more preferably is 0.005% or less. Note that, when it is desired to obtain the aforementioned effect, the content of Mg is preferably 0.0003% or more, and more preferably is 0.0005% or more.

In the chemical composition of the alloy material of the present invention, in addition to the elements described above, one or more kinds of element selected from V, Ti and Nb may also be contained within the ranges described below. The reason is described hereunder.

V: 0 to 0.50%

Ti: 0 to 0.50%

Nb: 0 to 0.50%

V, Ti and Nb have an action that refines the grains and improves the ductility, and therefore may be contained as necessary. However, if the content of any of these elements is more than 0.50%, a large amount of inclusions will form and, on the contrary, in some cases the ductility will be reduced. Therefore, the content of each of V Ti and Nb is set to 0.50% or less. The content of each of these elements is preferably 0.30% or less, and more preferably is 0.10% or less. Note that, when it is desired to obtain the aforementioned effect, the content of each of these elements is preferably 0.005% or more, more preferably is 0.01% or more, and further preferably is 0.02% or more.

Among the aforementioned V, Ti and Nb, any one element alone or a combination of any two or more kinds of element can be contained. When containing these elements in combination, the total content of these elements is preferably 0.5% or less.

In the chemical composition of the alloy material of the present invention, in addition to the elements described above, one or more kinds of element selected from Co, Cu and REM may also be contained within the ranges described below. The reasons for limiting each element are described hereunder.

Co: 0 to 2.0%

Co contributes to stabilization of the austenite phase and has an action that improves the stress corrosion cracking resistance at high temperatures, and therefore may be contained as necessary. However, if Co is excessively contained, it will lead to an increase in the alloy cost and the economic efficiency will be significantly impaired. Therefore, the content of Co is set to 2.0% or less. The content of Co is preferably 1.8% or less, and more preferably is 1.5% or less. Note that, when it is desired to obtain the aforementioned effect, the content of Co is preferably 0.1% or more, and more preferably is 0.3% or more.

Cu: 0 to 2.0%

Cu has an effect on the stability of a passivation film that is formed on the alloy material surface, and has an action that improves the pitting resistance and the general corrosion resistance, and therefore may be contained as necessary. However, if Cu is excessively contained, the hot workability will decrease. Therefore, the content of Cu is set to 2.0% or less. The content of Cu is preferably 1.8% or less, and more preferably is 1.5% or less. Note that, when it is desired to obtain the aforementioned effect, the content of Cu is preferably 0.1% or more, more preferably is 0.2% or more, and further preferably is 0.4% or more.

REM: 0 to 0.10%

REM has an action that improves the stress corrosion cracking resistance of the alloy material, and therefore may be contained as necessary. However, if REM is excessively contained, the amount of inclusions will increase and the hot workability will instead be reduced. Therefore, the content of REM is set to 0.10% or less. The content of REM is preferably 0.08% or less, and more preferably is 0.05% or less. Note that, when it is desired to obtain the aforementioned effect, the content of REM is preferably 0.0005% or more, and more preferably is 0.0010% or more.

Note that, the term "REM" is a generic term used to refer collectively to a total of 17 elements that are Sc, Y and the lanthanoids, and the term "content of REM" means the total content of one or more kinds of element among the REM elements. Further, REM is generally contained in a misch metal. Therefore, for example, REM may be added in the form of a misch metal and adjusted so that the content of REM falls within the aforementioned range.

In the chemical composition of the alloy material of the present invention, the balance is Fe and impurities. Here, the term "impurities" refers to components which, during industrial production of the alloy, are mixed in from a raw material such as ore or scrap or due to other causes, and which are allowed within a range that does not adversely affect the alloy material according to the present invention.

(B) Grain Size Number of Austenite Grains

The grain size number of austenite grains influences the yield strength of the alloy material according to the present invention. The alloy material of the present invention can be produced, for example, as described later, by performing hot rolling, a solution heat treatment, and cold working. In order to more reliably satisfy the yield strength defined in the present invention, the grain size number of austenite grains elongated in the working direction by cold working is preferably 1.0 or more in a cross section that is parallel to the rolling direction and thickness direction of the alloy material (hereinafter, this cross section is referred to as "L cross section"). The grain size number in the L cross section is more preferably 1.5 or more, and further preferably is 2.0 or more.

In the present invention, the grain size number of austenite grains is determined in accordance with the planimetric procedure described in ASTM E112-13. Specifically, first, a sample is cut out from the alloy material in a manner so that the L cross section can be observed. The observation surface is mirror-polished, electrolytically etched with 10% oxalic acid, and thereafter observed at a magnification of 100 to 500 times using an optical microscope, with the magnification being determined in a manner so that 50 grains are included in the visual field of the microscope.

Then, by substituting the number of grains for which the entire grain is included in the visual field, the number of grains for which one part of the grain is included in the visual field, and a numerical value described in ASTM E112-13 which is determined according to the magnification of the microscope into the following formula (iii), $N_A$ (number of grains per unit area $mm^2$) is calculated. In addition, the grain size number is determined from $N_A$ according to the relation described in ASTM E112-13.

$$N_A = f(N_{total} + (N_{intercepted}/2)) \quad \text{(iii)}$$

where, the meaning of each symbol in formula (iii) above is as follows.

$N_{total}$: number of grains for which the entire grain is included in visual field $N_{intercepted}$: number of grains for which one part of the grain is included in visual field f: numerical value described in ASTM E112-13 which is determined according to magnification of microscope (C) Yield Strength The yield strength (0.2% proof stress) of the alloy material according to the present invention is 1103 MPa or more. With this strength, the alloy material can be stably used even in oil wells drilled at greater depths and at higher temperatures. Note that, the yield strength is preferably 1275 MPa or less.

(D) Applications

Because the alloy material according to the present invention has high strength and excellent stress corrosion cracking resistance, the alloy material can be favorably used as an oil-well seamless pipe. Note that, the term "oil-well pipe" is, for example, as described in the definition column of "steel pipe for oil well casing, tubing and drilling" of No. 3514 in JIS G 0203 (2009), a generic term for casing pipes, tubing pipes, and drill pipes that are used for drilling of oil wells or gas wells, and extraction of crude oil or natural gas or the like. Further, the term "oil-well seamless pipe" refers to a seamless pipe that can be used, for example, for drilling of oil wells or gas wells, and extraction of crude oil or natural gas or the like.

(E) Production Method

The alloy material of the present invention can be produced, for example, as follows.

First, using an electric furnace, an AOD furnace, or a VOD furnace, melting is performed to adjust the chemical composition. Next, a molten alloy having the adjusted chemical composition is cast into an ingot, and may be thereafter worked into a so-called "alloy piece" such as a slab, a bloom or a billet by hot working such as forging. Alternatively, the molten alloy may be subjected to continuous casting and directly made into a so-called "alloy piece" such as a slab, a bloom or a billet.

In addition, using the "alloy piece" as starting material, hot working is performed to form the alloy piece into a desired shape such as a plate material or a tube blank. For example, in the case of working the "alloy piece" into a plate material, the "alloy piece" can be subjected to hot working into a plate shape or coil shape by hot rolling. Further, for example, in the case of working the "alloy piece" into a tube blank such as a seamless pipe, the "alloy piece" can be subjected to hot working into a tubular shape by a hot extrusion tube-making process or the Mannesmann pipe making process.

Next, in the case of a plate material, a solution heat treatment is performed on the hot-rolled material, and cold working may thereafter be performed by cold rolling. In the case of a tube blank, the hollow shell that underwent the hot working is subjected to a solution heat treatment, and thereafter cold working may be performed by cold drawing or cold rolling such as Pilger rolling. Note that, in order to make the grain size number of austenite grains in the L cross section 1.0 or more, in the solution heat treatment it is preferable to hold the hot-rolled material or hollow shell within the temperature range of 1000 to 1200° C. for one minute or more.

Although the area reduction will differ depending on the chemical composition of the alloy, it suffices to perform the aforementioned cold working once or multiple times to achieve an area reduction of around 31 to 50% in terms of the area reduction ratio. Similarly, although the area reduction will differ depending on the chemical composition of the alloy, in the case of performing an intermediate heat treatment after cold working and thereafter performing further cold working once or multiple times in order to work the material into a predetermined size, it suffices to perform the cold working to achieve an area reduction of around 31 to 50% in terms of the area reduction ratio after the intermediate heat treatment.

Hereunder, the present invention is described more specifically by way of examples, although the present invention is not limited to these examples.

Example

Alloys having the chemical compositions shown in Table 1 were melted in a vacuum high frequency induction furnace and cast into ingots of 50 kg. Alloys 1 to 18 in Table 1 are alloys which each had a chemical composition within the range defined in the present invention. On the other hand, alloys 19 to 28 are alloys which each had a chemical composition that deviated from the conditions defined in the present invention.

TABLE 1

| | Chemical composition (by mass % balance: Fe and impurities) | | | | | | | | | | | | | | | | |
|---|---|---|---|---|---|---|---|---|---|---|---|---|---|---|---|---|---|
| Alloy | C | Si | Mu | P | S | Cr | Ni | sol. Al | N | O | Mo | W | V | Other | FuI† | Nmax‡ | |
| 1 | 0.006 | 0.15 | 0.41 | 0.017 | 0.0005 | 28.1 | 39.94 | 0.100 | 0.339 | 0.003 | 3.01 | — | 0.03 | Ca: 0.0008, Co: 0.80, Cu: 0.78, REM: 0.008 | 3.0 | 0.356 | Inventive example |
| 2 | 0.006 | 0.15 | 0.41 | 0.017 | 0.0005 | 29.2 | 39.94 | 0.100 | 0.344 | 0.003 | 3.01 | — | 0.03 | REM: 0.013 | 3.0 | 0.397 | |
| 3 | 0.001 | 0.45 | 0.28 | 0.010 | 0.0007 | 34.3 | 39.60 | 0.062 | 0.369 | 0.008 | 5.50 | — | — | REM: 0.0J7 | 5.5 | 0.661 | |
| 4 | 0.001 | 0.30 | 0.48 | 0.005 | 0.0004 | 34.6 | 40.90 | 0.147 | 0.339 | 0.003 | 2.90 | — | 0.04 | Ca: 0.0032, REM: 0.081 | 2.9 | 0.663 | |
| 5 | 0.009 | 0.42 | 0.37 | 0.012 | 0.0008 | 34.6 | 47.20 | 0.104 | 0.331 | 0.008 | 5.90 | — | 0.02 | Ca: 0.0014, Mg: 0.0037, REM: 0.012 | 5.9 | 0.592 | |
| 6 | 0.010 | 0.31 | 0.27 | 0.020 | 0.0006 | 35.1 | 49.00 | 0.055 | 0.372 | 0.006 | 2.60 | 4.6 | 0.04 | Ca: 0.0012, Mg: 0.0016, REM: 0.0044 | 4.9 | 0.607 | |
| 7 | 0.003 | 0.27 | 0.23 | 0.009 | 0.0003 | 37.3 | 49.70 | 0.095 | 0.317 | 0.002 | 5.80 | — | 0.05 | Cu: 0.8, REM: 0.016 | 5.8 | 0.754 | |
| 8 | 0.006 | 0.15 | 0.41 | 0.017 | 0.0005 | 38.9 | 39.94 | 0.100 | 0.501 | 0.003 | 3.01 | — | 0.03 | Nb: 0.03, REM: 0.082 | 3.0 | 0.986 | |
| 9 | 0.007 | 0.30 | 0.47 | 0.013 | 0.0006 | 28.5 | 36.10 | 0.098 | 0.324 | 0.003 | 3.40 | — | — | REM: 0.051 | 3.4 | 0.423 | |
| 10 | 0.003 | 0.39 | 0.35 | 0.014 | 0.0008 | 29.6 | 37.30 | 0.071 | 0.335 | 0.007 | 6.00 | — | 0.04 | Ca: 0.0021, REM: 0.015 | 6.0 | 0.449 | |
| 11 | 0.008 | 0.20 | 0.29 | 0.011 | 0.0003 | 34.2 | 44.80 | 0.051 | 0.386 | 0.006 | 5.40 | — | 0.05 | Co: 0.6, Cu: 0.7, REM: 0.046 | 5.4 | 0.592 | |
| 12 | 0.005 | 0.36 | 0.41 | 0.015 | 0.0004 | 36.7 | 49.10 | 0.140 | 0.375 | 0.004 | 4.70 | 2.3 | 0.03 | REM: 0.020 | 5.9 | 0.716 | |
| 13 | 0.010 | 0.24 | 0.33 | 0.006 | 0.0007 | 29.9 | 41.40 | 0.077 | 0.354 | 0.007 | 3.20 | — | — | REM: 0.041 | 3.2 | 0.407 | |
| 14 | 0.007 | 0.49 | 0.34 | 0.013 | 0.0003 | 31.8 | 38.10 | 0.115 | 0.334 | 0.005 | 3.10 | 5.8 | — | Ti: 0.04, REM: 0.022 | 6.0 | 0.540 | |
| 15 | 0.004 | 0.21 | 0.31 | 0.016 | 0.0007 | 35.9 | 47.50 | 0.131 | 0.359 | 0.004 | 4.40 | 2.5 | 0.02 | Ca: 0.0023, Co: 0.9, REM: 0.018 | 5.7 | 0.675 | |
| 16 | 0.008 | 0.32 | 0.32 | 0.018 | 0.0006 | 35.9 | 52.30 | 0.051 | 0.348 | 0.004 | 3.80 | 3.4 | 0.02 | Ca: 0.0016, Co: 0.3, Cu: 0.8, REM: 0.015 | 5.5 | 0.632 | |
| 17 | 0.008 | 0.13 | 0.35 | 0.016 | 0.0005 | 39.4 | 36.30 | 0.095 | 0.398 | 0.002 | 5.80 | — | 0.04 | — | 5.8 | 1.078 | |
| 18 | 0.001 | 0.43 | 0.28 | 0.010 | 0.0007 | 34.1 | 38.50 | 0.058 | 0.352 | 0.005 | — | 11.2 | — | REM: 0.017 | 5.6 | 0.663 | |
| 19 | 0.010 | 0.34 | 0.21 | 0.007 | 0.0006 | 27.6 | 37.50 | 0.134 | 0.315 | 0.008 | 5.00 | — | — | REM: 0.021 | 5.0 | 0.372 | Comparative example |
| 20 | 0.010 | 0.45 | 0.10 | 0.014 | 0.0003 | 42.1 | 44.60 | 0.095 | 0.478 | 0.008 | 3.60 | — | — | REM: 0.016 | 3.6 | 1.213 | |
| 21 | 0.008 | 0.23 | 0.06 | 0.019 | 0.0008 | 33.7 | 24.30 | 0.061 | 0.377 | 0.005 | 3.10 | — | — | REM: 0.024 | 3.1 | 0.876 | |
| 22 | 0.007 | 0.14 | 0.39 | 0.017 | 0.0005 | 28.4 | 31.50 | 0.100 | 0.382 | 0.008 | 3.01 | — | 0.03 | REM: 0.008 | 3.0 | 0.492 | |
| 23 | 0.006 | 0.15 | 0.41 | 0.017 | 0.0007 | 29.9 | 39.94 | 0.100 | 0.339 | 0.016 | 3.01 | — | 0.03 | REM: 0.018 | 3.0 | 0.427 | |
| 24 | 0.006 | 0.15 | 0.41 | 0.017 | 0.0005 | 29.9 | 39.94 | 0.100 | 0.520 | 0.003 | 3.01 | — | 0.03 | REM: 0.013 | 3.0 | 0.427 | |

TABLE 1-continued

| Alloy | Chemical composition (by mass % balance: Fe and impurities) | | | | | | | | | | | | | | | |
|---|---|---|---|---|---|---|---|---|---|---|---|---|---|---|---|---|
| | C | Si | Mu | P | S | Cr | Ni | sol. Al | N | O | Mo | W | V | Other | FuI† | Nmax‡ |
| 25 | 0.008 | 0.21 | 0.33 | 0.006 | 0.0007 | 30.1 | 42.40 | 0.074 | 0.550 | 0.008 | 3.10 | — | — | REM: 0.008 | 3.1 | 0.404 |
| 26 | 0.004 | 0.19 | 0.38 | 0.012 | 0.0007 | 32.8 | 45.00 | 0.140 | 0.284 | 0.007 | 3.90 | — | — | REM: 0.022 | 3.9 | 0.508 |
| 27 | 0.011 | 0.25 | 0.60 | 0.017 | 0.0008 | 28.4 | 36.20 | 0.095 | 0.190 | 0.003 | 3.16 | — | — | REM: 0.017 | 3.2 | 0.418 |
| 28 | 0.001 | 0.49 | 0.38 | 0.005 | 0.0006 | 34.9 | 36.70 | 0.108 | 0.325 | 0.002 | 0.80 | — | — | — | 08 | 0.739 |

†FuI = Mo + (1/2)W

‡Nmax = $0.000214 \times Ni^2 - 0.03012 \times Ni + 0.00215 \times Cr^2 - 0.08567 \times Cr + 1.927$ Each ingot was subjected to a holding treatment at 1200° C. for 3 hours, and thereafter subjected to hot forging to be worked into a square bar having a cross section of 50 mm×50 mm. Each square bar obtained in this manner was further heated at 1200° C. for 1 hour, and thereafter subjected to hot rolling to be finished into a plate material having a thickness of 14.2 mm.

Next, the plate material was subjected to a solution heat treatment for 15 minutes at the temperature described in Table 2, and thereafter the plate material on which a water cooling treatment had been performed was used for cold working to be finished into a plate material having a thickness of 8.4 mm.

TABLE 2

| Alloy | Solutionizing temperature (° C.) | Austenite grain size number | Yield strength (MPa) | Stress corrosion cracking resistance | |
|---|---|---|---|---|---|
| 1 | 1150 | 1.7 | 1139 | ○ | Inventive example |
| 2 | 1150 | 1.8 | 1152 | ○ | |
| 3 | 1150 | 1.6 | 1137 | ○ | |
| 4 | 1100 | 4.0 | 1131 | ○ | |
| 5 | 1100 | 4.0 | 1119 | ○ | |
| 6 | 1150 | 2.7 | 1142 | ○ | |
| 7 | 1050 | 4.6 | 1111 | ○ | |
| 8 | 1150 | 5.3 | 1336 | ○ | |
| 9 | 1050 | 4.8 | 1125 | ○ | |
| 10 | 1100 | 4.1 | 1118 | ○ | |
| 11 | 1150 | 2.7 | 1164 | ○ | |
| 12 | 1150 | 2.7 | 1150 | ○ | |
| 13 | 1150 | 2.8 | 1178 | ○ | |
| 14 | 1100 | 3.9 | 1122 | ○ | |
| 15 | 1100 | 4.2 | 1177 | ○ | |
| 16 | 1100 | 4.2 | 1149 | ○ | |
| 17 | 1050 | 4.7 | 1125 | ○ | |
| 18 | 1150 | 2.0 | 1162 | ○ | |
| 19 | 1050 | 5.0 | 1116 | x | Comparative example |
| 20 | 1150 | 2.6 | 1309 | x | |
| 21 | 1150 | 2.9 | 1158 | x | |
| 22 | 1150 | 1.8 | 1197 | x | |
| 23 | 1150 | 2.0 | 1147 | x | |
| 24 | 1150 | 2.4 | 1378 | x | |
| 25 | 1150 | 2.7 | 1394 | x | |
| 26 | 1050 | 4.5 | 1034 | ○ | |
| 27 | 1250 | 0.9 | 968 | ○ | |
| 28 | 1050 | 5.1 | 1117 | x | |

Various performance evaluation tests that are described below were conducted using the obtained test materials.

<Austenite Grain Size Number>

Determination of the austenite grain size number was performed in accordance with the planimetric procedure described in ASTM E112-13. Specifically, as described above, the number of grains in the L cross section is counted by using an optical microscope to perform observation at a magnification of 100 to 500 times depending on the grain size, and the grain size number is determined.

<Yield Strength>

A round bar tensile test specimen in which the diameter of a parallel portion was 4 mm and the gage length was 34 mm was taken from the rolling direction of each of the plate materials described above, a tensile test was performed at room temperature, and the yield strength (0.2% proof stress) was determined. Note that, the elastic stress rate during the test was set to 1.0 mm/min, which corresponds to a strain rate of $4.9\times10^{-4}$/s.

<Stress Corrosion Cracking Resistance>

A slow strain rate test specimen having a parallel portion measuring 3.81 mm in diameter and a length of 25.4 mm was taken from the rolling direction of each plate material described above, in conformance with the slow strain rate test method defined in NACE TM0198. A slow strain rate test conforming to NACE TM0198 was then performed, and the stress corrosion cracking resistance was evaluated.

Two conditions were specified for the test environment in the aforementioned slow strain rate test: in an atmospheric environment and in an environment simulating a hostile oil-well environment ($H_2S$ partial pressure: 0.7 MPa, $CO_2$ partial pressure: 1.0 MPa, 25% NaCl, temperature: 204° C.). In both of the environments, the strain rate in the tensile test was set at $4.0\times10^{-6}$/s.

Further, in the evaluation of the stress corrosion cracking resistance, specifically, three slow strain rate test specimens were taken from each plate material, and for one test specimen out of the three test specimens, the value of plastic strain to failure and the value of reduction in area were determined by a tensile test in an atmospheric environment (hereinafter, these values are referred to as a "reference value of plastic strain to failure" and a "reference value of reduction in area", respectively). For the remaining two test specimens, the value of plastic strain to failure and the value of reduction in area were determined by a tensile test in an environment simulating the aforementioned hostile oil-well environment (hereinafter, these values for each test specimen are referred to as a "comparison value of plastic strain to failure" and a "comparison value of reduction in area", respectively). In other words, in the present Example, for each plate material, one "reference value of plastic strain to failure", two "comparison values of plastic strain to failure", one "reference value of reduction in area", and two "comparison values of reduction in area" were determined.

Then, for each plate material, differences between the "reference value of plastic strain to failure" and the two "comparison values of plastic strain to failure" were determined respectively (hereinafter, each of these differences is referred to as "difference in plastic strain to failure"). Similarly, differences between the "reference value of reduction in area" and the two "comparison values of reduction in area" were determined respectively (hereinafter, each of these differences is referred to as "difference hi reduction in area"). In this examination, the following targets were set for the stress corrosion cracking resistance: all the "differences in plastic strain to failure" shall be 20% or less of the "reference value of plastic strain to failure", and all the "differences in reduction in area" shall be 20% or less of the "reference value of reduction in area". If the aforementioned targets could be achieved, it was determined that the stress corrosion cracking resistance was excellent.

The results of the above examination are shown in Table 2. In the table, the symbol "0" in the "stress corrosion cracking resistance" column indicates that the aforementioned targets for the stress corrosion cracking resistance were achieved, while on the other hand, the symbol "×" indicates that the targets for the stress corrosion cracking resistance could not be achieved.

It is evident from Table 2 that with respect to each alloy material satisfying the conditions defined in the present invention, the austenite grains are fine, the alloy material is high in strength with a yield strength (0.2% proof stress) of 1103 MPa or more, and the alloy material is also excellent in stress corrosion cracking resistance in an environment in which the temperature is a high temperature of 200° C. or more and which includes hydrogen sulfide and carbon dioxide.

On the other hand, with respect to the materials that deviated from the range defined in the present invention, the result was that the 0.2% proof stress was less than 1103 MPa, or the material was inferior in stress corrosion cracking resistance. In alloys 19 and 20 the content of Cr was outside the range defined in the present invention, in alloys 21 and 22 the content of Ni was outside the range defined in the present invention, and in alloy 28 the value of Fn1 was outside the range defined in the present invention, and consequently the result was that these alloys were inferior in stress corrosion cracking resistance.

In alloy 23, the added amount of 0 was more than the range of the present invention, and in alloys 24 and 25 the added amount of N was more than the range of the present invention, and consequently the result was that these alloys were inferior in stress corrosion cracking resistance. Further, in alloy 26, the added amount of N was lower than the range of the present invention, and consequently, although the stress corrosion cracking resistance was excellent, the yield strength was less than 1103 MPa. Further, with respect to alloy 27, because the solutionizing temperature was more than 1200° C., the austenite grain size number was less than 1.0. In addition, because the added amount of N was lower than the range of the present invention, the yield strength was less than 1103 MPa.

INDUSTRIAL APPLICABILITY

The alloy material of the present invention is excellent in strength and in stress corrosion cracking resistance at high temperatures. Therefore, the alloy material and oil-well seamless pipe of the present invention, for example, are suitable for casing pipes, tubing pipes, and drill pipes and the like that are used for drilling of oil wells or gas wells, and extraction of crude oil or natural gas or the like.

The invention claimed is:

1. An alloy material, having:

a chemical composition consisting of, in mass %,

C: 0.030% or less,

Si: 0.01 to 1.0%,

Mn: 0.01 to 2.0%,

P: 0.030% or less,

S: 0.0050% or less,

Cr: 28.0 to 40.0%,

Ni: 32.0 to 55.0%, sol. Al: 0.010 to 0.30%,

N: more than 0.30% and not more than $N_{max}$ that is defined by formula (i) below, O: 0.010% or less, Mo: 0 to 6.0%, W: 0 to 12.0%, Ca: 0 to 0.010%, Mg: 0 to 0.010%, V: 0 to 0.50%, Ti: 0 to 0.50%, Nb: 0 to 0.50%, Co: 0 to 2.0%, Cu: 0 to 2.0%, REM: 0 to 0.10%, and the balance: Fe and impurities, wherein:

Fn1 defined by formula (ii) below is 1.0 to 6.0, and a yield strength at a 0.2% proof stress is 1103 MPa or more;

$$N_{max}=0.000214\times Ni^2-0.03012\times Ni+0.00215\times Cr^2-0.08567\times Cr+1.927 \quad (i)$$

$$Fn1=Mo+(1/2)W \quad (ii)$$

where, each symbol of an element in the above formulas represents a content (mass %) of the corresponding element contained in the alloy material, with 0 being substituted when the corresponding element is not contained, wherein a grain size number of austenite grains in a cross section parallel to a rolling direction and a thickness direction is 1.0 or more.

2. The alloy material according to claim 1, wherein:

the alloy material is used as an oil-well seamless pipe.

3. The alloy material according to claim 1, wherein:

the chemical composition contains one or more kinds of element selected from, in mass %, V: 0.01 to 0.50%, Ti: 0.01 to 0.50%, and Nb: 0.01 to 0.50%.

4. The alloy material according to claim 3, wherein:

the alloy material is used as an oil-well seamless pipe.

5. The alloy material according to claim 1, wherein:

the chemical composition contains one or more kinds of element selected from, in mass %, Co: 0.1 to 2.0%, Cu: 0.1 to 2.0%, and REM: 0.0005 to 0.10%.

6. The alloy material according to claim 5, wherein:

the alloy material is used as an oil-well seamless pipe.

* * * * *